US005358251A

United States Patent [19]

Ashton

[11] Patent Number: 5,358,251

[45] Date of Patent: Oct. 25, 1994

[54] GOLF TRAINING AID/SIMULATOR

[76] Inventor: James T. Ashton, 33 Woodgrange Gardens, Bush Hill Park, Enfield, Middx, England

[21] Appl. No.: 123,813

[22] Filed: Sep. 20, 1993

Related U.S. Application Data

[63] Continuation of Ser. No. 834,334, Feb. 12, 1992, abandoned.

[30] Foreign Application Priority Data

Aug. 14, 1989 [GB] United Kingdom ..... 8918510

[51] Int. Cl.[5] ..... A63B 69/36

[52] U.S. Cl. ..... 273/195 B; 273/32 C; 273/183.1; 273/187 R; 273/187.1

[58] Field of Search ..... 273/183.1, 186.1, 187.1, 273/187 R, 195 R, 195 B, 32 C

[56] References Cited

U.S. PATENT DOCUMENTS

| | | | |
|---|---|---|---|
| 2,879,996 | 3/1959 | Lederer | 273/195 B |
| 3,169,022 | 2/1965 | Kretsinger | 273/187 R |
| 3,352,559 | 11/1967 | Larsen | 273/195 R |
| 3,633,917 | 1/1972 | Anderson | 273/195 B |
| 3,633,918 | 1/1972 | Smiley et al. | 273/195 B |
| 3,639,923 | 2/1972 | Stewart | 273/195 B |
| 3,869,127 | 3/1975 | Kohori | 273/195 B |
| 4,146,231 | 3/1979 | Merkle et al. | 273/195 B |
| 4,304,406 | 12/1981 | Cromarty | 273/187 R |
| 4,577,868 | 3/1986 | Kiyonoga | 273/183 A |
| 4,875,684 | 10/1989 | Benilan | 273/195 B |

FOREIGN PATENT DOCUMENTS

| | | | |
|---|---|---|---|
| 2587627 | 3/1987 | France | 273/195 B |
| 2177010 | 1/1987 | United Kingdom . | |

*Primary Examiner*—Jessica J. Harrison
*Attorney, Agent, or Firm*—Davis, Bujold & Streck

[57] ABSTRACT

The aid/simulator provides an improvement in known equipment to enable the user to simulate a range of shots which can be expected during a round of golf. According to this invention, the aid/simulator comprises a base (1) providing a standing area (4) on which the user takes a stance in relating to a ball playing area (3) which is characterized by the base including a platform (2) adjustably mounted on the base so that it can be tilted to a position in relation to the ball the user wishes to practice or simulate, such as an uphill, or downhill lie or standing above, or below the ball, and a drive mechanisms (11, 12) is provided for tilting the platform to a selected position. Advantageously, two marked areas (14) are provided corresponding to the user's foot positions, and pressure responsive devices are provided for detecting the weight distribution between the respective feet, signals from which are fed during a golfing swing to a comparator mechanism, and thence to an indicator mechanism (17) for showing the percentage of bodyweight taken by each foot during a swing.

19 Claims, 4 Drawing Sheets

GOLF TRAINING AID/SIMULATOR

This is a continuation of copending application Ser. No. 07/834,334 filed on Feb. 12, 1992 now abandoned.

BACKGROUND OF THE INVENTION

This invention relates to a golf training aid/simulator.

Such equipment is known, of which the most basic is a golf practice range where individual booths are provided, each comprising a base normally in the form of a rubber mat alongside of which is provided a strip of artificial grass on which the ball can be placed to be hit. Also, golf training aids/simulators are known which include means for detecting the speed and direction of the ball after impact to provide an indication of the quality of the golf shot.

SUMMARY OF THE INVENTION

According to this invention, there is provided a golf training aid/simulator comprising a base providing a standing area on which the user takes his stance in relation to a ball playing area, characterised by the base including a platform which is adjustably mounted on said base so that it can be tilted to a position in relation to the ball the user wishes to practise or simulate, i.e. an uphill, or downhill lie and/or standing above, or below the ball, and drive means for tilting the platform to a selected position.

Preferably, a folding bellows is provided around the periphery of the platform and is attached to the base to prevent ingress of dirt and yet permit tilting of the platform to be effected.

Advantageously, the standing area of the platform provides two marked areas corresponding to the user's foot positions, which are provided with known pressure responsive devices for detecting the weight distribution between the respective feet, signals from which are fed during a golfing swing to comparator means, and thence to indicator means for showing the percentage of bodyweight taken by each foot at address and the transfer of weight during a swing. It will be appreciated here that such information would be most useful in analysing the swing and assessing what changes should be made to improve the swing.

It will be further appreciated that, in accordance with the invention, a training aid/simulator is provided that enables a golfer to practice or simulate the full range of shots he is likely to meet on a golf course and, in conjunction with the advantageous feature referred to above, to be able to review his balance through each swing.

Conveniently, a chart may be provided showing the perfect balance and weight transfer required for the range of shots that can be achieved using the simulator/training aid, so that the user can compare them with his actual results to assess what corrections to his swing are desirable.

To effect tilting of the platform, the latter may be supported over its area by vertically extending telescopic units, which are interconnected so as to be lengthened or contracted relatively to one another, as appropriate, to move the platform to a required angle of tilt, said units being electrically, hydraulically or pneumatically controlled via appropriate control means.

Alternatively, to effect said tilting, the platform may be mounted centrally on a universal elongate joint providing X and Y horizontal pivot axes, and, at least one telescopic unit may be provided for each axis, which units are arranged to act in concert with each other to cause the platform to tilt via the universal joint into a required tilt angle.

According to an advantageous feature of the invention, the ball playing area on the base is provided with a surface which can be changed as desired by the golfer to represent different course conditions, such as a fairway, semi-rough and rough, where artificial grass would be used, and perhaps sand.

According to a further advantageous feature of this invention, the training aid/simulator may be linked via a suitable known Computer/CPU interface to a Computer loaded with a known software program providing data of a "golf course", whereby the user can simulate and practise a "round of golf". In this case, as already known in the art, a known electronic sensing arrangement (ESD) would be provided in the base to pick up the speed and direction of the club head on impact with a ball so as to determine the landing position of the ball on the "course".

BRIEF DESCRIPTION OF THE DRAWINGS

In order that the invention may be readily understood, and further features made apparent, one embodiment of a golf training aid will now be described, with reference to the accompanying drawings, in which.

DESCRIPTION OF THE PREFERRED EMBODIMENT

Figure 1:
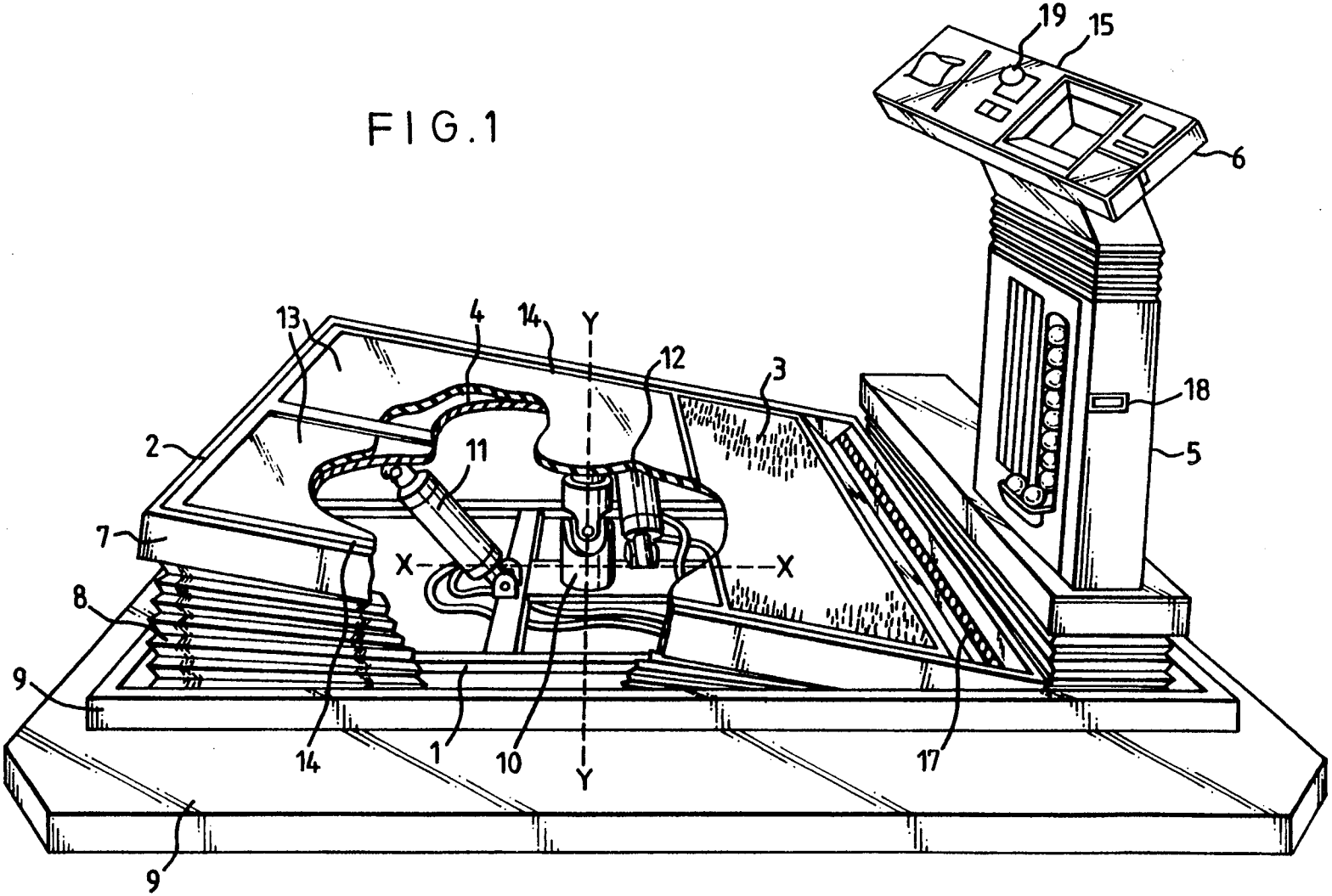
FIG. 1 is an overall perspective view of the golf training aid.

Referring to FIG. 1, the aid comprises a rectangular base 1 having a tiltable platform 2 providing a ball playing area 3 and a standing area 4. At one, front, end of the base a pedestal 5 is provided on top of which a control panel 6 is mounted.

The platform 2 is of sheet metal appropriately stiffened by internal stiffeners (not shown) and a marginal flange 7 and is mounted on the base 1 via a folding bellows arrangement 8 to enable the platform to be tilted as described hereinafter and prevent the ingress of dirt. As shown the base, in turn, forms part of, or is mounted on, a plinth 9.

The platform and bellows are cut-away in the Figure to show that the platform 2 is centrally mounted on a vertically extending universal joint 10 the joint halves of which are mounted to pivot around two horizontal pivot axes X, Y whereby tilting can be effected around either axis or a combination of both to cover a complete range of "lies". That is, the platform is mounted centrally on two vertically alignable elongate support members, one of the support members is centrally mounted to the base and the other of the support members is centrally mounted to an undersurface of the platform. A universal joint, providing X and Y horizontal pivoting axes, interconnects adjacent ends of the two vertically alignable elongate support members to effect the tilting. At least one extending telescopic unit 11, 12 respectively is provided for each pivot axis, each of which is connected between the base and platform as shown and these units are connected by an appropriate network of pipes if hydraulically or pneumatically operated, or wires if electrically operated 25, whereby they can be moved in unison by different amounts under the control of suitable control means to set the angle of tilt required for the platform 2. A rubber mat 13 or similar is provided over the standing area 4 and is marked with two outlines 14 to define the foot positions of the user. A control device, which may conveniently be in the form of a joystick 15 is provided on the panel which is operative through a suitable known control circuit 26 to move the platform 2 as required by the user, in which case a known scale or indicator (not shown) may be provided to give the user a visual indication of the tilt angle set.

Known pressure sensing devices 27 are provided beneath the outlines 14 of the standing area 4, which are operative known suitable comparator circuit 28 to sense the weight distribution between the golfer's feet when he addresses the practise ball and the weight transference during his swing, and to pass this information to a known balance indicator which in this embodiment comprises a strip 17 of L.e.d's or other similar visual indicators as shown along the front of the platform 2.

As mentioned hereinbefore, a chart strip (not shown) may also be provided to show the preferred weight distribution for comparison.

In this embodiment, a known computer/CPU interface port 18 is provided on the pedestal 5 (or the control panel if preferred) for connection to a Computer 30 to enable the user to play a simulated round of golf as mentioned hereinbefore. Also, a known coin and/or card meter may be provided by removable squares of "grass" of different height to simulate fairway, semi-rough and rough, as required. Alternatively, the different surfaces could be provided on three sides of a rotatable drum (not shown) mounted beneath the platform 2 in which case the appropriate surface would be rotated into position by a suitable operating member.

Figure 2:
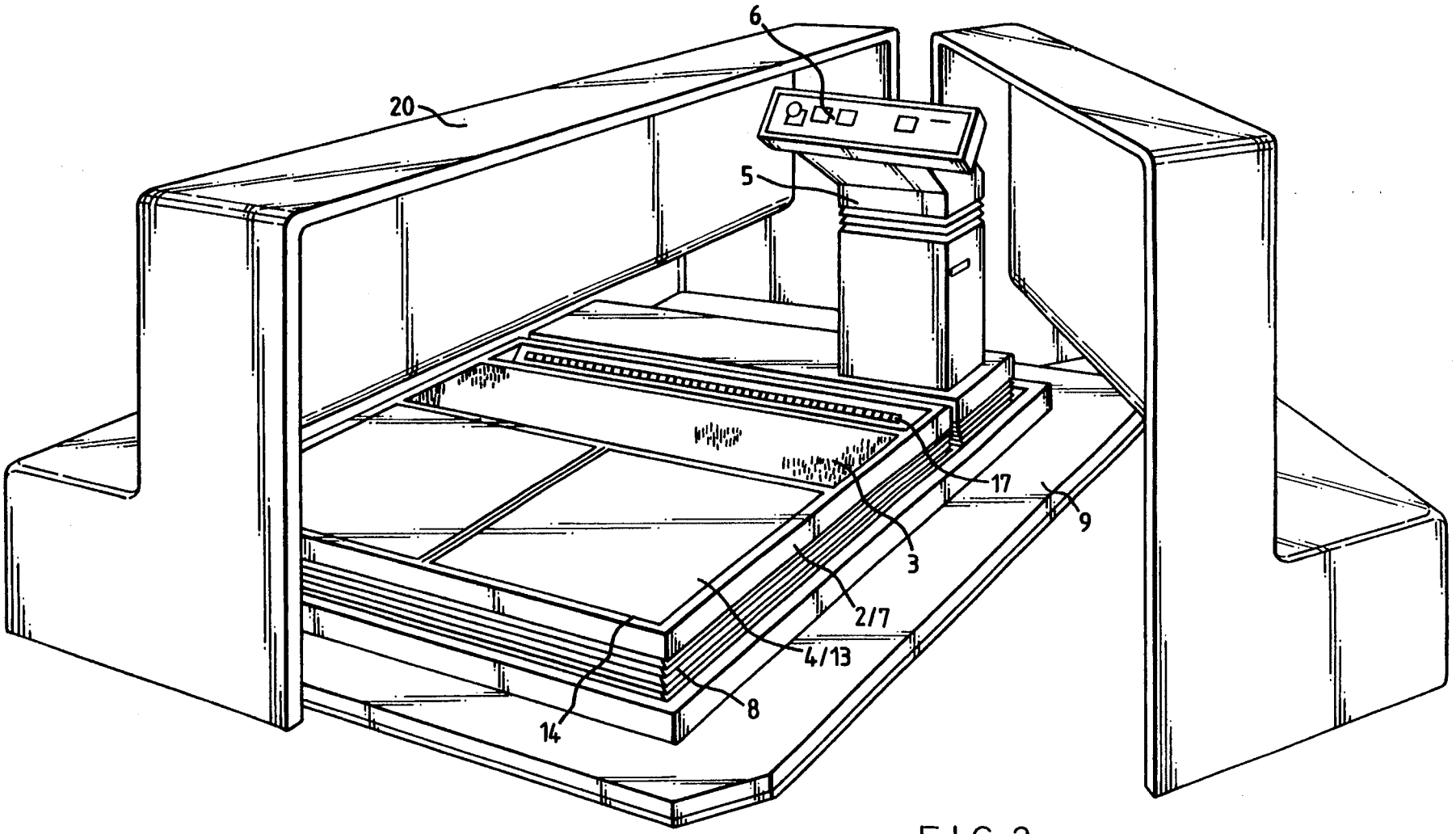
FIG. 2 is another perspective view incorporating a security cover, FIGS. 3 (A) to (D) are perspective views showing the aid in use.
Figure 3A:
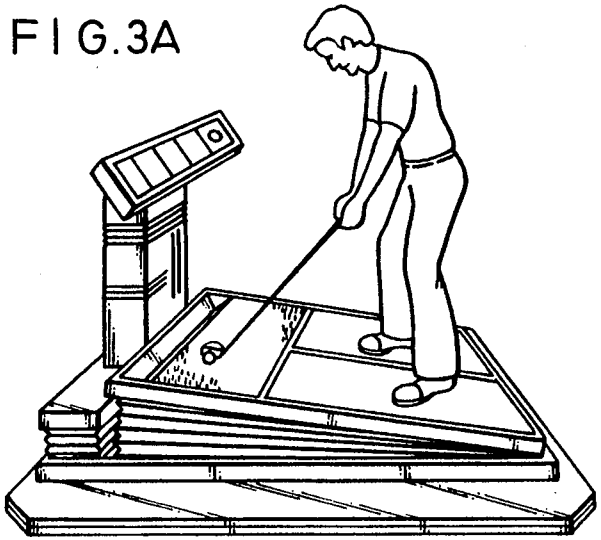
Figure 3B:
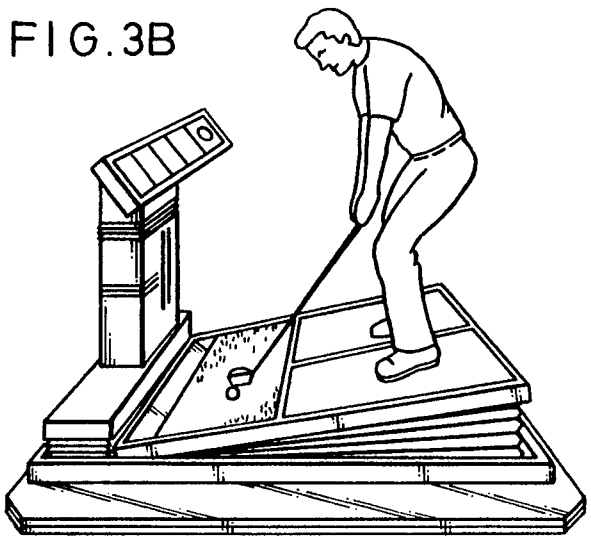
Figure 3C:
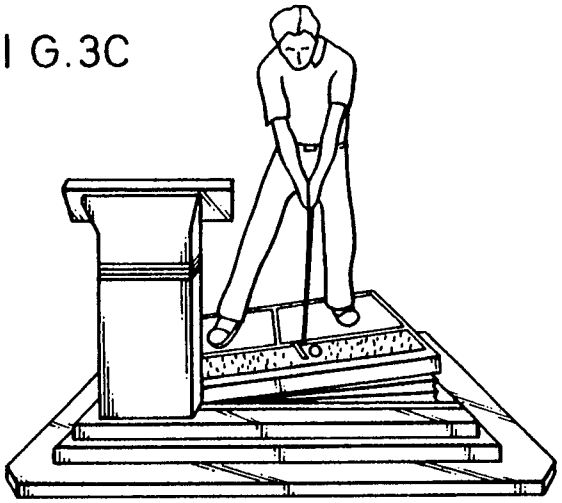
Figure 3D:
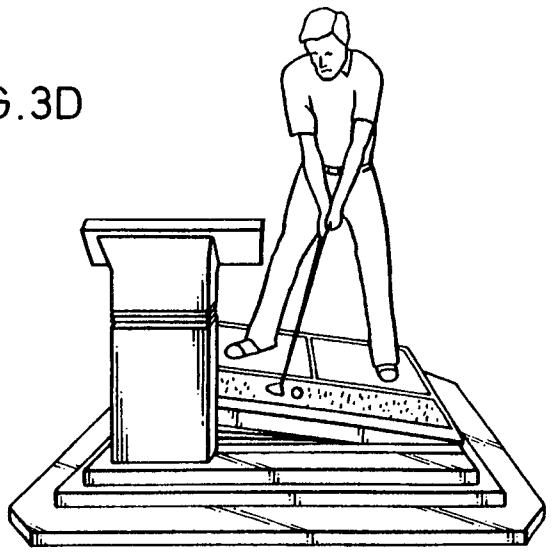
Figure 4:
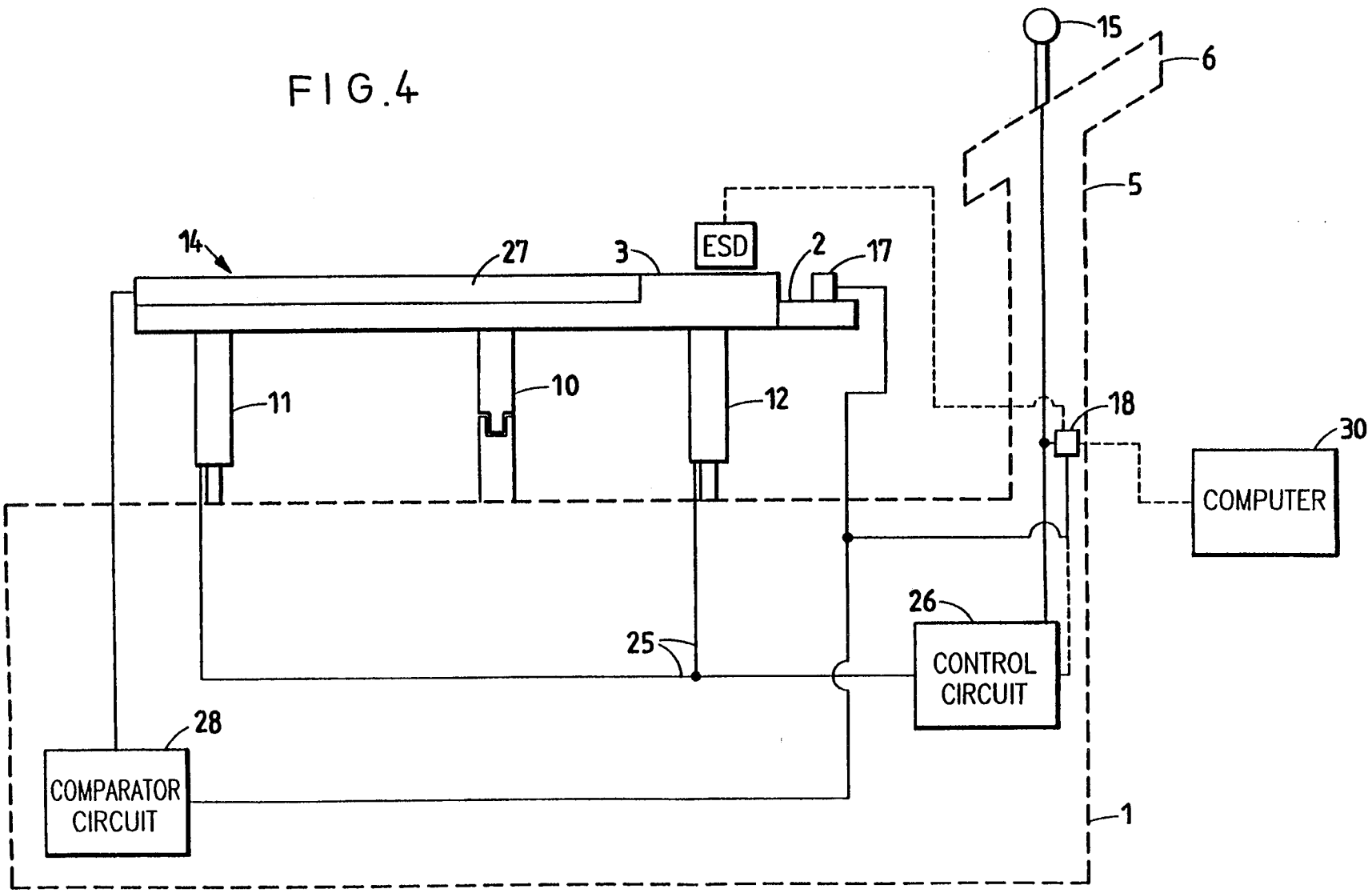
FIG. 4 is a diagrammatic representation showing the interconnection of the various components of the present invention.

When not in use, the complete unit described above can be closed-off and locked by a pair on interfitting covers 20 as shown in FIG. 2.

Referring to FIG. 3, the platform 2 is shown tilted for practising (A) standing below the ball, (B) standing above the ball, (C) an uphill lie, and (D) a downhill lie.

I claim:

1. A golf training device comprising a base including a platform providing a standing area for a user to take a stance in relation to a ball playing area, the platform is adjustably mounted on the base whereby the platform is tiltable to a desired position in relation to a practice ball and means for tilting and maintaining the platform in a desired selected position, wherein the platform is mounted centrally on two vertically alignable elongate support members, one of said support members is centrally mounted to said base and the other of said support members is centrally mounted to an under surface of said platform, a universal joint, providing X and Y horizontal pivot axes, interconnects adjacent ends said two vertically alignable elongate support members together to effect said tilting, at least one telescopic unit is connected between the base and the under surface of the platform for the X horizontal pivot axis, and at least one telescopic unit is connected between the base and the under surface of the platform for the Y horizontal axis, and the telescopic units are arranged to act in concert with one another to cause the platform to tilt via the universal joint into and maintain a desired tilt angle.

2. A golf training device according to claim 1, wherein the platform is tiltable to simulate one of an uphill lie, a downhill lie, a standing above the ball lie and a standing below the ball lie and the means for tilting and maintaining the platform in a desired selected position is controllable by the user when standing on the platform.

3. A golf training device according to claim 2, wherein the platform is supported on the base by vertically extending telescopic units to effect tilting of the platform, and the telescopic units are interconnected to be one of lengthened and contracted relatively to one another, as appropriate, to move the platform to a desired angle of tilt.

4. A golf training device according to claim 3, wherein the telescopic units are controlled by one of electrically, hydraulically or pneumatically control means.

5. A golf training device according to claim 2, wherein a folding bellows surrounds and is attached to the periphery of both the platform and the base to prevent ingress of dirt while permitting tilting of the platform to be effected.

6. A golf training device according to claim 5, wherein the ball playing area is provided with a surface which can be changed, as desired, by the user to represent different course conditions.

7. A golf training device according to claim 2, wherein the ball playing area is provided with a surface which can be changed, as desired, by the user to represent different course conditions.

8. A golf training device according to claim 1, wherein a folding bellows surrounds and is attached to the periphery of both the platform and the base to prevent ingress of dirt while permitting tilting of the platform to be effected.

9. A golf training device according to claim 8, wherein the ball playing area is provided with a surface which can be changed, as desired, by the user to represent different course conditions.

10. A golf training device according to claim 1, wherein the ball playing area is provided with a surface which can be changed, as desired, by the user to represent different course conditions.

11. A golf training device according to claim 1, wherein the platform is supported on the base by vertically extending telescopic units to effect tilting of the platform, and the telescopic units are interconnected to be one of lengthened and contracted relatively to one another, as appropriate, to move the platform to a desired angle of tilt.

12. A golf training device according to claim 11, wherein the telescopic units are controlled by one of electrically, hydraulically or pneumatically control means.

13. A golf training device according to claim 1, wherein results of a golf swing are provided to show a perfect balance and weight transfer required for a golf shot that can be achieved using the golf training aid/-simulator, whereby the user can compare the perfect balance and weight transfer required for a golf shot with actual results to assess what corrections to the golf swing of the user are desirable.

14. A golf training device according to claim 1, wherein a strip of LED's are provided adjacent a front edge of the platform to indicate actual balance and weight transfer information.

15. A golf training device according to claim 1, wherein the golf training aid/simulator is linked via a suitable computer/CPU interface to a computer containing a software program with data of a desired golf course, whereby the user can simulate and practice a round of golf.

16. A golf training device according to claim 1, wherein the standing area of the platform has two marked areas corresponding to foot positions of the user, which are provided with pressure responsive devices for detecting a weight distribution between the respective feet, signals from which are fed during a golfing swing to comparator means, and thence to indicator means for showing the percentage of bodyweight taken by each foot while addressing the ball and the transfer of weight during swing.

17. A golf training device comprising a base including a platform providing a standing area for a user to take a stance in relation to a ball playing area, the a platform is adjustably mounted on the base whereby the platform is tiltable to a desired position in relation to a practice ball, and drive means for tilting and maintaining the platform in a desired selected position, wherein the platform is in one section and is mounted to overlie an elongate plinth thereby to be tiltable relative to the plinth, the platform is mounted centrally on two vertically alignable elongate support members, one of said support members is centrally mounted to said base and the other of said support members is centrally mounted to an under surface of said platform, a universal joint, providing X and Y horizontal pivot axes, interconnects adjacent ends said two vertically alignable elongate support members together to effect said tilting, at least one telescopic unit is connected between the base and an under surface of the platform for the X horizontal pivot axis, and at least one telescopic unit is connected between the base and the under surface of the platform for the Y horizontal pivot axis, the telescopic units are arranged to act in concert with one another to cause the platform to tilt about the universal joint to a desired tilt angle, the standing area of the platform is defined by two marked areas, each marked area corresponds to a foot position of the user, pressure sensing devices are provided beneath said two marked areas for detecting a weight distribution between the respective feet of the user, during use, output signals are generated by the pressure sensing devices and fed to a comparator, an output from the comparator is sent to balance indicator to indicate an actual body weight supported by each foot, as the user addresses the ball, and an actual transfer weight, during the swing of the user, and results are provided to show a desired balance and weight transfer during a golf swing required for a complete range of golf shots that are achievable using the golf training device whereby, in use, the user compares the desired balance and weight transfer with actual balance and weight transfer results for accessing corrections needed to balance the swing of the user.

18. A golf training device according to claim 17, wherein the golf training aid/simulator is linked via a suitable computer/CPU interface to a computer containing a software program with data of a desired golf course, whereby the user can simulate and practice a round of golf.

19. A golf training device comprising a base including a platform providing a standing area for a user to take a stance in relation to a ball playing area, the platform is adjustably mounted on the base whereby the platform is tiltable to a desired position in relation to a practice ball and drive means for tilting and maintaining the platform in a desired selected position, wherein the platform is in one section and is mounted to overlie an elongate plinth thereby to be tiltable relative to the plinth, means for tilting the platform as desired, the standing area of the platform is defined by two marked areas, each marked area corresponds to a foot position of the user, pressure sensing devices are provided beneath said two marked areas for detecting a weight distribution between the respective feet of the user; during use, output signals are generated by the pressure sensing devices and fed to a comparator, an output from the comparator is sent to and displayed by a balance indicator to indicate an actual body weight supported by each foot, as the user addresses the ball, and an actual weight transfer, during the swing of the user, whereby the user can see actual body weight and actual weight transfer, during a swing, and determine corrections needed to balance the swing of the user.

* * * * *